US005529237A

United States Patent [19]

Yashima et al.

[11] Patent Number: 5,529,237

[45] Date of Patent: Jun. 25, 1996

[54] METHOD OF FORMING A METALLIC COATING LAYER UTILIZING MEDIA HAVING HIGH ENERGY

[75] Inventors: Yoshinobu Yashima; Chen zhen ha; Yahong Wang, all of Sendai, Japan

[73] Assignee: Japan Basic Material Co., Ltd., Sendai, Japan

[21] Appl. No.: 272,137

[22] Filed: Jul. 8, 1994

[30] Foreign Application Priority Data

Aug. 28, 1992 [JP] Japan ..... 4-251860

[51] Int. Cl.[6] ..... B23K 20/00

[52] U.S. Cl. ..... 228/115; 427/242; 427/216

[58] Field of Search ..... 228/101, 231, 228/115; 427/216, 242

[56] References Cited

U.S. PATENT DOCUMENTS

| | | | |
|---|---|---|---|
| 3,617,350 | 11/1971 | Kuchek | 427/242 X |
| 4,655,832 | 4/1987 | Omori et al. | 427/242 X |
| 4,880,132 | 11/1989 | Coch et al. | 427/242 X |
| 5,074,908 | 12/1991 | Boswell et al. | 427/242 X |
| 5,322,666 | 6/1994 | Watwe | 419/32 |
| 5,372,845 | 12/1994 | Rangaswamy et al. | 427/242 X |

*Primary Examiner*—Kenneth J. Ramsey
*Attorney, Agent, or Firm*—Dilworth & Barrese

[57] ABSTRACT

The present invention discloses a method of forming a metallic coating layer utilizing media having high energy which are capable of employing every kind of solid particulate.

By employing the media having high energy, metallic powders as coating material are stricken onto the surface of an object to be coated so as to increase gradually the thickness of the metallic coating layer by repeating the aforementioned striking operation. Thus, the component of the metallic coating layer may be mechanically alloyed with the object to be coated.

12 Claims, 3 Drawing Sheets

METHOD OF FORMING A METALLIC COATING LAYER UTILIZING MEDIA HAVING HIGH ENERGY

BACKGROUND OF THE INVENTION

The present invention relates to a method of forming a metallic coating layer utilizing media having high energy, and more particularly relates to a method of forming the metallic coating layer utilizing the media having high energy which is capable of employing every kind of solid particulate as coating material.

Hitherto, mechanical plating has been known in public and further has been put into practical use. Regarding the method of plating, an object to be plated, metallic powders as plating material, media and suitable liquid are charged into a container and then plating is carried out by rotating said container in suitable rotating speed.

As the media, a glass or metal ball may be employed. Water, petroleum or a surface active agent added to water may also be employed as liquid.

By rotating the container, metallic powders comprising copper powder etc., are stricken onto the surface of the object to be coated by means of the media. As and as a result, the metallic powders adhere to the surface of the object to be coated so as to gradually increase the thickness thereof, thereby forming a plated layer (a coated layer).

The metallic powders are thus stricken to the surface air-tightly due to the mechanism of cold welding.

The plated layer(coated layer) thus formed has a minute formation with little pin holes and also has superior anti-corrosion to that of electric plating for reason that the pin holes are filled up with the metallic powders stricken thereto due to a mechanical element.

Now, the metallic powders employed in the aforementioned mechanical plating as plating material are stricken onto the surface of the object to be coated by means of a certain kind of media. However, a conventional media having striking kinetic energy is low and therefore the metals employed in the metallic plating were limited to soft metals such as copper, zinc, cadmium, alminum or tin etc. Hard metals were difficult to employ.

As described above, hard metals do not adhere air-tightly onto the surface of the object to be coated due to the media having low kinetic energy even when those are stricken thereto. Therefore, it was difficult to form a plated layer (a coated layer) and. Further, since the conventional mechanical plating eventually employs a container, there were difficulties in plating a large sized product.

SUMMARY OF THE INVENTION

With the above in mind, an object of the present invention is to provide a method of forming a metallic coating layer utilizing the media having high kinetic energy (hereinafter referred to as "high energy") which are capable of employing hard metals as coating material so as to obtain the minute formation of a metallic coating layer.

The above object of the present invention can be achieved by providing a method of forming a metallic coating layer utilizing media having high energy comprising metal powders or a thin strip being stricken impulsively onto the surface of an article to be coated by employing high energy media, said impulsively striking being repeated so as to increase the thickness of the metallic coating layer gradually while adding the metallic powders little by little,thereby mechanical alloying the component of said metallic coating layer with the object to be coated.

According to the method of forming a metallic coating layer utilizing the media having high energy of the present invention, the powders stricken onto the surface of the object to be coated are not only subjected to cold welding onto the surface of the object to be coated, but also are alloyed due to mechanical alloying phenomena at the surfaces of the metallic coating layer and the object to be coated by means of the media having high energy. Therefore, the coating layer of soft metals, not to mention that of hard metals, may be adhered onto the surface of the object to be coated air-tightly.

A coating layer of an alloy may be formed due to mechanical alloying phenomena by carrying out multicomponent coating of two kinds or more. For example, after carrying out mechanical plating by employing the mixed powder of Ni and Al with an atomic ratio of 3:1 by means of the media having high energy, the intermetallic compound layer of $Ni_3Al$ with minute formation of a coating layer without pin holes may be formed by carrying out a suitable heat treatment. Likewise, a super hard alloy coating layer such as WC,TiC etc., may also be formed by the same mechanism as above.

Because of the same minute formation as that of a conventional plating, a coating layer having superior anti-corrosion to that of electroplating in addition to excellent mechanical performance, heat resistance and high temperature oxidizing resisting property, may respectively be formed.

The high energy mechanical coating according to the present invention does not employ liquid or medicaments necessary for carrying out a conventional plating. Therefore, the cost of raw materials is low. At the same time the cost necessary for treating waste liquid is not necessary. Furthermore, the high energy mechanical coating may be carried out by employing a comparatively simple device. Thus, the production cost becomes low, resulting in practical use in a wide range.

DESCRIPTION OF THE PREFERRED EMBODIMENTS

Figure 1:
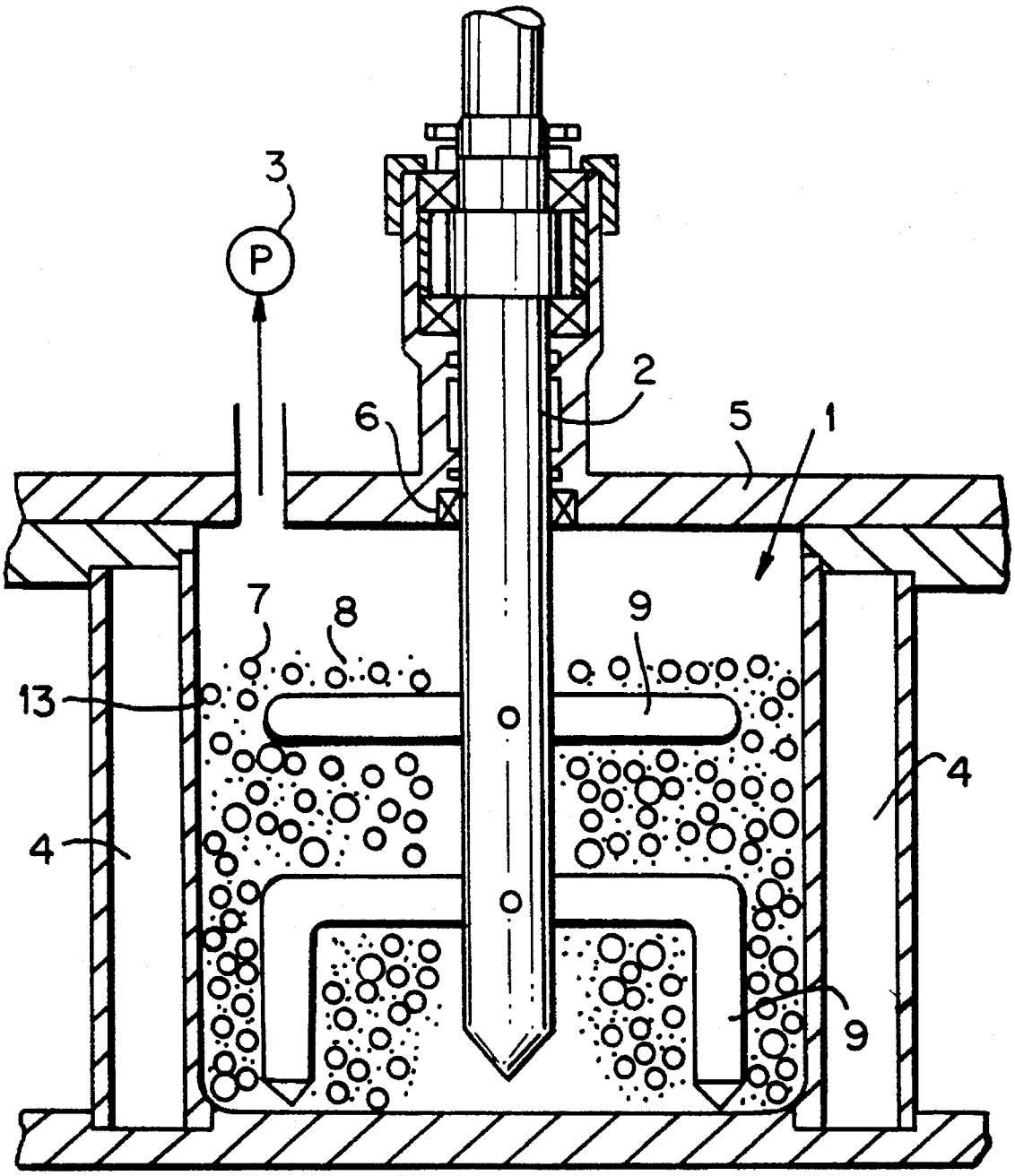
FIG. 1 is a central longitudinal sectional view of an agitation type high energy mechanical coating device employed in the present invention.

According to the method of the present invention, metallic powders as coating material are stricken onto the surface of an object to be coated by means of an agitation type, an oscillation type or a shot blast type high energy mechanical plating device. When the agitation type high energy device is employed, the object to be coated and the media are charged into the same container after said container has been vacuous or filled with inert gas.

As described above, when the object to be coated is small in size, a container may be employed as occasion demands. However, said container is employed in order to prevent scattering the metallic powders,media and the object to be coated. Therefore, the container is not always necessary if there is the other means to ensure the hermetical property.

The media employed in the present invention has high energy exerting impact on the object to be coated due to accelerated speed, which is different from a conventional media. Therefore, a hard ball endurable for the impact is employed as the media.

The reason for employing a surface active agent according to a conventional mechanical plating method resides in that an oxide film of the grain surface of metallic powders is washed to be clean so as to form the new surface. That is to say, it is not sufficient to form the new atomic surface on the grain surface of the metallic powders due to low energy. Therefore, it is necessary to dissolve the oxide film on the grain surface by employing alkalescent or weak acid liquid.

In the case of the high energy, on the other hand, the grain may be deformed due to strong impact of the media. Therefore, the grain surface of the metallic powders forms new atomic surface fully, thereby adhering to the object to be coated as it stands.

The elevational difference of the kinetic energy may be evaluated by the grinding speed of metallic powders. A high energy mechanical device employed in Examples has high grinding speed of ten times or more compared with that of a conventional mechanical plating device.

As described above, the elevational difference of kinetic energy between the conventional mechanical plating and the present invention resides in that there is the maximum of the energy value of media according to the conventional plating; the energy increases in proportion to the increase of rotation frequency of a panel from zero. On the other hand, the value decreases in proportion to the increase of the rotation frequency when it exceeds a certain value.

According to the present invention, there is no maximum of the value of energy theoretically; the value may cause to vary widely as occasion demands. In a practical view, the impact caused by the media generates high pressure of several tens to several hundreds times compared with that of the conventional mechanical plating.

The oxide films adhered to the surface of the object to be coated and metallic powders are destroyed due to strong impact of the media. As a result clean and new atomic surfaces may be formed. Thus, due to direct contact of the newly formed surfaces each, an atom causes mutual diffusion easily between each surface so as to join together.

When an active ingredient exists, it is necessary to inhibit oxidation of the newly formed surface of a coated layer in order to obtain a coating layer with minute formation and also suffice air-tightness. For this purpose, it is necessary to proceed with the prosecution in vacuum or in an atmosphere of inert gas.

When the shot blast type high energy mechanical plating device is employed, the media injected from the shot blast device smashes against the surface of the object to be coated in a state of mixing with the metallic powders. At the same time, said powders are stricken onto the surface thereof. At that time, the metallic powders are added little by little.

By repeating the above process, the minute formation of a coating layer may be obtained with further increases in the thickness gradually while being alloyed. The metallic coating layer thus formed may be processed to sufficient hardening due to high energy processing as a result of accumulated energy quantity of the impact received repeatedly.

According to the present invention, in order to obtain the high energy processing, the metallic powders are charged frequently, but in small quantity every time. When said metallic powders are stricken onto the surface of the object to be coated, the higher the energy received, the smaller the quantity.

An effective solid phase reaction occurs between the metallic powders each and also the powders and the object to be coated so as to weld with pressure air tightly.

A feature of the method according to the present invention resides in that it is not only possible to adhere the coating material to the object to be coated, but also to form a reaction alloy layer due to the reaction of the metallic powders stricken in the state of the mechanical alloying phenomena with the surface of the object to be coated.

The mechanical alloying phenomena mean the phenomena for alloying different kinds of chemical elements by mutually mixing atoms thereof. The feature resides in alloying in the state of a solid which is different from a general way of alloying two kinds or more of metals and metal or nonmetal after dissolving the same together so as to solidify.

The metallic powders employed in the coating method according to the present invention may have the form of a thin strip. There is no limitation to the configuration. Further, the smaller the grain size, the more effective. Since the device employed in the present invention can satisfactorily smash metallic powders effectively, every kind of the grain size can be smashed by means of the media can be employed.

By carrying out heat treatment of the metallic coating layer formed through the high energy mechanical coating process, scattering and reaction of each component of said coating layer and also at the object to be coated are further advanced when said metallic coating layer is thermally treated. That is to say, a sintering effect can simultaneously be obtained.

The heat treatment as an auxiliary process according to the present invention differs in the conditions of temperature, time and atmosphere, etc., depending upon coating material, mainly depending upon the dissolving point of the coating material and further upon the dissolving point of the component in the case of multicomponent coating.

For example, as described above when the metallic coating layer of intermetallic compound of $Ni_3Al$,$Fe_3Al$,TiAl, etc., is formed, the metallic layer of heat resisting intermetallic compound may be obtained by sintering at a temperature from 800–13000 K. due to the existence of simple substance Al having a low dissolving point.

Hereinafter, the device employed in the present invention will be described with reference to the drawings.

As shown in FIG. 1, the basic construction of an agitation type high energy mechanical coating device comprises a rotatable shaft 2 of a container 1 installed vertically and said shaft 2 is rotated by means of a motor (not illustrated). The inside of said container 1 may be vacuous by means of a vacuum pump 3 and the sides of the container 1 are cooled by means of water cooled jackets 4. The rotatable shaft 2 and a lid 5 are sealed vacuously by means of an O ring 6.

Within the container 1, media 7 (this media serve as an object to be coated 13 in the shape of a steel ball with a diameter of 10 mm in this Example) and metallic powders 8 are filled. By rotating the rotatable shaft 2, agitating wings 9 agitate fully the inside of the container 1 so as to cause strong collision of the media and object to be coated, thereby forming a metallic coating layer onto the surface of the object to be coated 13.

Figure 2:
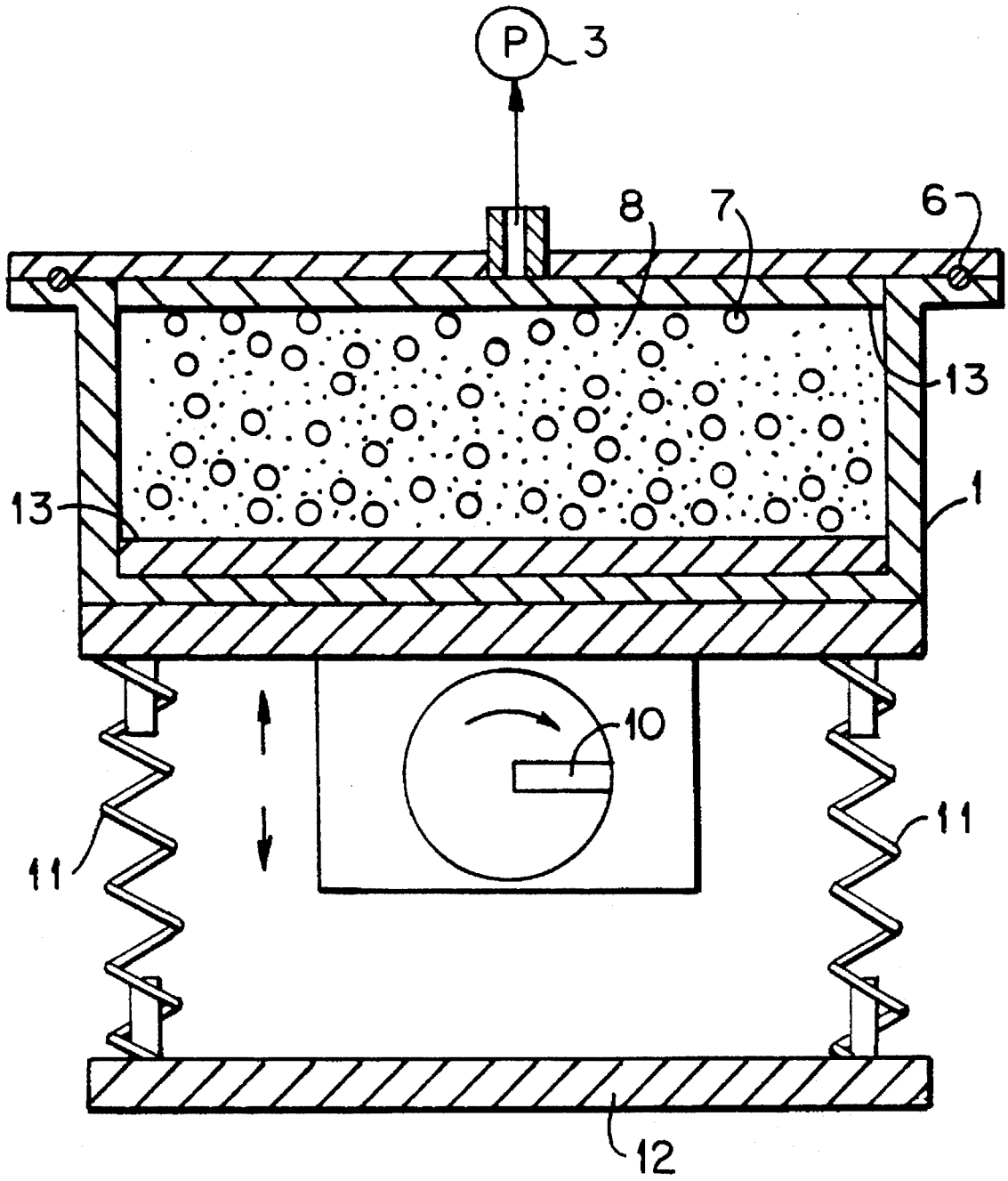
FIG. 2 is a central longitudinal sectional view of an oscillation type high energy mechanical coating device employed in the present invention.

FIG. 2 shows the basic construction of a oscillation type high energy mechanical coating device. Ref. No. 1 denoted a container the inside of which, may be vacuous. Said container 1 is installed at an oscillating table 12 which is oscillated by means of an oscillator 10 and springs 11. By rotating an oscillating motor(not illustrated), the oscillating table 12 and the container 1 are caused to oscillate up and down.

The object to be coated 13 in the shape of a strip is fixed firmly to the inner side of the container 1 and when the object to be coated is small in size, the media 7, metallic powders 8 and object 13 are received together within the container 1.

Figure 3:
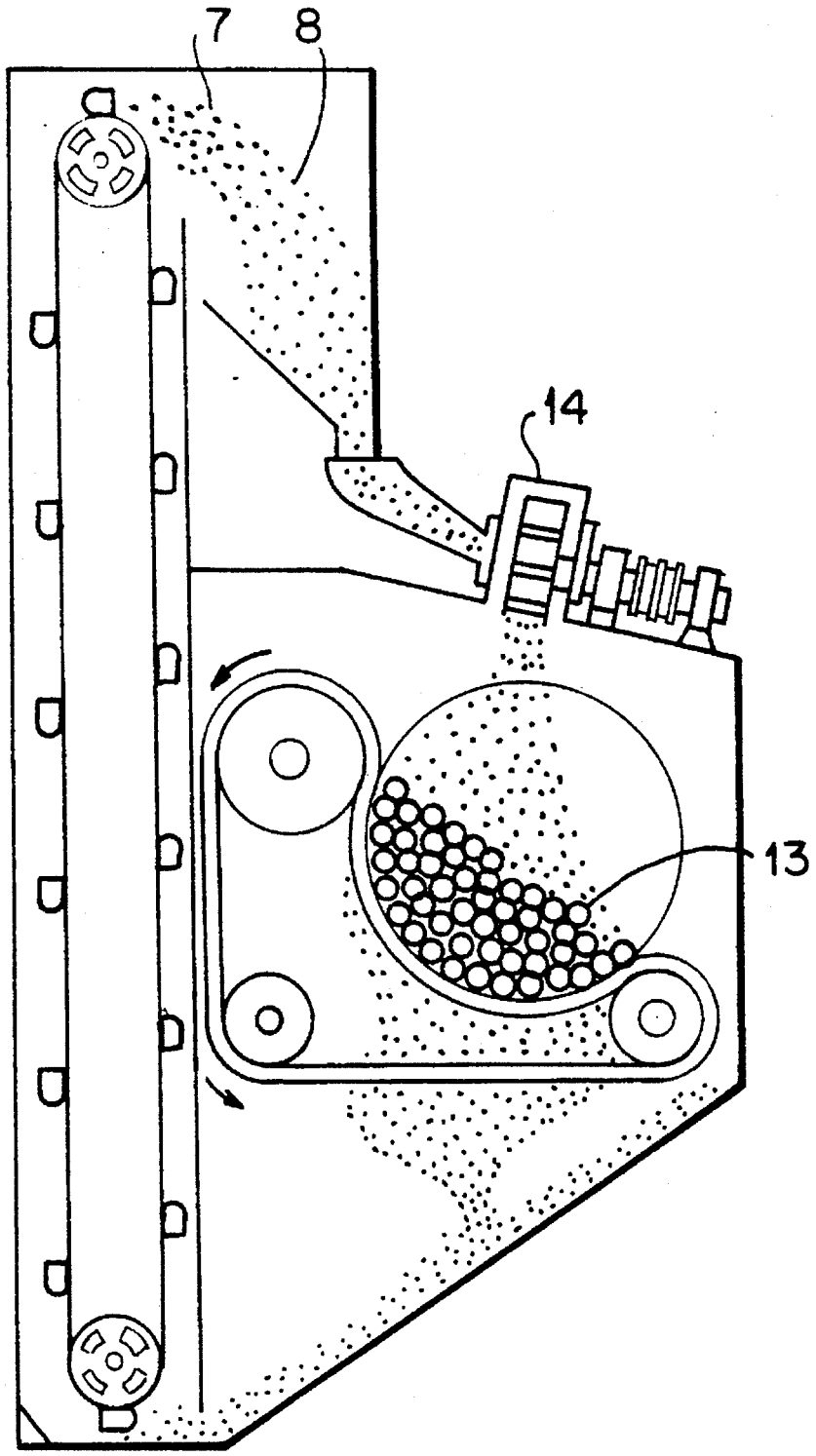
FIG. 3 is a central longitudinal sectional view of a shot blast type high energy mechanical coating device employed in the present invention.

FIG. 3 shows the basic construction of a shot blast type high energy mechanical coating device. The mixture of the media 7 and metallic powders 8 is injected in high speed toward the object to be coated 13, thereby forming a metallic coating layer onto the surface of said object 13. Ref. No. 14 denotes a shot blasting device.

The present invention will be described in detail with reference to the Examples:

EXAMPLE 1

This is an example for forming a coating layer of hard tungsten. By employing an agitation type high energy mechanical coating device, tungsten is coated onto an object to be coated in the shape of a steel ball with a diameter of 10 mm.

2 kg of a steel ball with a diameter of 10 mm and log of tungsten powders with 2 μ of an average grain diameter were charged into a container 1 so as to coat the same in 0.5 to 30 hrs. 10 g of tungsten powders were further charged thereinto with the device thereafter caused to rotate. By repeating the aforementioned cycle ten times, 100 μ of a metallic coating layer was formed.

EXAMPLE 2

Each 10 g of the mixture of tungsten powder and carbon powder with 2μ of an average grain size and 1:1 of atomic ratio were charged into the container of an agitation type high energy coating device and coated in the same manner in Example 1 and further thermally treated about for 2 hours at a temperature from 1200° K. to 1700° K. in vacuum, thereby forming the coating layer of super hard alloy WC. Said coating layer with a minute formation was adhered to an object to be coated air tightly.

EXAMPLE 3

By employing a shot blast type high energy mechanical coating device, an object to be coated in the shape of a strip was coated with the mixture of Ti and Al. Metallic powders of Ti and Al with 1:1 of atomic ratio were mixed uniformly with media so as to coat for 10 minutes. The intermetallic compound layer of TiAl was formed under heat treatment for about 2 hours at a temperature from 800 to 1300°k.

EXAMPLE 4

10 g of Al powder with 5040 μ kg and 2 kg of steel balls were charged into the container of an oscillation type high energy mechanical coating device and coated for 30 minutes. Thereafter, 1.2 g of Si powder with 540 μ were charged into the same container so as to coat. The powders of Al and Si were repeatedly charged thereinto ten times so as to repeat the formation of a metallic coating layer. The product thus obtained was thermally treated for 0.5 to 1 hours at a temperature of 670° K. so as to obtain a uniform metallic coating layer having the composition of Al–12 wt. % Si. The formation was a very minute one. Likewise, an alloy coating layer of Al—Si having the compositions of Si with 20 wt. % and 40 wt. % was obtained.

EXAMPLE 5

The metallic coating layer of Si was formed by means of an agitation type high energy mechanical coating device. 2 kg of a steel ball and 20 g of metallic powders were charged into a container and agitated for 0.5 hours so as to form the coating layer of Si.

EXAMPLE 6

10 g of amorphous alloy powders of $Zr_{60}Cu_{40}$ and 2 kg of a steel ball were charged into the container of an oscillation type high energy coating device. Further, an object to be coated in the shape of Al strip is fitted to an upper and lower inner sides of the container. About 5μ in thickness of a coating layer was formed by carrying out coating for 30 minutes.

As described above, according to the present invention, every metallic solid particulate may be employed as coating material. Further, it is considerably effective to form a coating layer with hard metals, active elements, multicomponent complex coating or thermally unstable amorphous alloy, etc.

Furthermore, a metallic coating layer obtained reveals the clean atomic surface. Therefore, said layer may be utilized as a sophisticated catalytic film.

Since the surface of the metallic coating layer is clean, it can be utilized as a preplating material such as hot dipping, etc. Furthermore, according to the present invention, it may also be possible to apply for a cementation by carrying out heat treatment of the component to be scattered after having been stricken onto the surface of an object to be coated.

What is claimed is:

1. A method of forming a metallic coating layer utilizing media having high energy, comprising:

injecting from a shot blast type high energy coating device, metallic powder and media having high energy toward an object to be coated, whereby the metallic powder impulsively strikes a surface of the object to be coated and forms a metallic layer thereon, and repeating the striking operation so as to increase gradually thickness of the metallic layer while incrementally adding the metallic powder from the shot blast type device and thereby mechanically alloying a component or components of the metallic coating layer on and/or with the object to be coated.

2. The method according to claim 1, wherein the media having high energy exert impact on the object to be coated in accelerated speed.

3. The method according to claim 2, wherein steel balls endurable for the impacting are employed as the media having high energy.

4. The method according to claim 1, wherein the coating layer not only adheres to the object to be coated, but also the metallic powder striking the object in a state of mechanical alloying reacts with the surface of the object, thereby forming a reaction alloy layer.

5. The method according to claim 1, wherein the object to be coated is in the shape of a strip.

6. The method according to claim 1, wherein the metallic powder includes at least one of Cu, Zn, Cd, Al, Sn, Ni, Fe, Ti, W, C, Si and Zr.

7. The method according to claim 6, wherein an alloy of WC, $Ni_3Al$, $Fe_3Al$, TiAl, TiC, SiAl, or $Zr_{60}CU_{40}$ is formed as the coating layer.

8. The method according to claim 1, comprising the additional step of heat treating the metallic coating layer to obtain a sintering affect.

9. The method according to claim 8, wherein the sintering is carried out at a temperature of 800°–1300° K.

10. The method according to claim 2, wherein the sintering is carried out at a temperature of 1200°–1700°K.

11. The method according to claim 1, comprising the additional step of carrying out the coating in a vacuum or inert gas atmosphere to inhibit oxidation of the coating layer.

12. The method according to claim 1, wherein the metallic powder having high energy repeatedly strikes the surface of the object to be coated by rotating a container so as to increase gradually the thickness of the coating layer with minute formation due to a cold welding mechanism.

* * * * *